United States Patent [19]

Langen

[11] Patent Number: 4,514,964

[45] Date of Patent: May 7, 1985

[54] PACKAGING MACHINES

[75] Inventor: Marinus J. M. Langen, Rexdale, Canada

[73] Assignee: H. J. Langen & Sons Limited, Mississauga, Canada

[21] Appl. No.: 533,070

[22] Filed: Sep. 19, 1983

[51] Int. Cl.[3] ..... B65B 35/44; B65B 35/50

[52] U.S. Cl. ..... 53/540; 53/252

[58] Field of Search ..... 53/531, 540, 543, 247, 53/252, 251; 198/422; 414/51, 53, 77

[56] References Cited

U.S. PATENT DOCUMENTS

| | | | |
|---|---|---|---|
| 3,391,777 | 7/1968 | Joa | 198/422 |
| 3,408,926 | 11/1968 | Rogerson | 53/540 X |
| 3,879,920 | 4/1975 | Langen | 53/252 X |
| 4,078,357 | 3/1978 | Ida | 53/543 X |
| 4,248,027 | 2/1981 | Cleary et al. | 53/251 X |
| 4,413,462 | 11/1983 | Rose | 198/422 |

*Primary Examiner*—Horace M. Culver

*Attorney, Agent, or Firm*—Fetherstonhaugh & Co.

[57] ABSTRACT

A packaging machine has a loading station in which load items are loaded into a container. A load transport conveyor extends through the loading station. A load supporting compartment is formed on the conveyor. The compartment has a discharge passage opening from the trailing end thereof and a guide at the trailing end for guiding a load item toward the discharge passage. A receiver is located in said loading station for receiving a load item discharged from the load supporting compartment. A stop is located in the loading station and extends into the path upstream of said receiver whereby the movement of a load item carried by the load supporting compartment along the path is arrested by contact with said stop means and continued movement of the load transporting conveyor causes the load item to engage the guide to be directed thereby through the discharge passage into the receiver.

12 Claims, 6 Drawing Figures

PACKAGING MACHINES

This invention relates to packaging machines. In particular, this invention relates to a load accumulator for a packaging machine for loading end loading cartons.

PRIOR ART

There are many items which must be packaged in an orderly array which consists of a plurality of stacks of items arranged in a side-by-side relationship. A typical example is a package containing sanitary napkins in which a plurality of napkins are arranged in a plurality of side-by-side stacks within a carton.

Considerable difficulty has been experienced in loading these items at high speed into cartons.

The improved load accumulator of the present invention permits high-speed accumulation of a load and the transfer of the accumulated load into cartons with ease at high speed.

SUMMARY OF INVENTION

According to one aspect of the present invention there is provided in a packaging machine having a loading station in which load items are loaded into a container, the improvement of a load transport conveyor having a forward run extending through said loading station in a first direction along a first path, a load supporting compartment formed on said conveyor, said compartment having a leading end and a trailing end, a discharge passage opening from the trailing end of said compartment, guide means at the trailing end of said compartment for guiding a load item toward said discharge passage, receiver means located in said loading station for receiving a load item discharged from said load supporting compartment, stop means located in said loading station and extending into said path upstream of said receiver means whereby the movement of a load item carried by said load supporting compartment along said path in said first direction is arrested by contact with said stop means and continued movement of the load transporting conveyor causes the load item to engage the guide means to be directed thereby through the discharge passage into the receiver means, and, means for discharging the load item from the receiver means.

According to a further aspect of the present invention there is provided in a carton loading machine for loading end loading cartons having a carton transporting conveyor which has a plurality of carton supports adapted to transport open ended cartons through a carton loading station, the improvement of a load transporting conveyor having a forward run extending through said loading station in a first direction along a first path, a plurality of load supporting compartments formed on said load transporting conveyor at spaced intervals along the length of the forward run, each compartment having a leading end and a trailing end, a discharge passage opening downwardly from each compartment at the trailing end thereof, a guide ramp at the trailing end of each compartment extending downwardly and rearwardly toward the discharge passage, a load accumulator conveyor mounted for movment through said loading station, a plurality of load accumulating receptacles mounted on said load accumulator conveyor for movement through said loading station, each of said receptacles having a load stacking portion underlying said path of said load supporting compartments and a load storage portion extending laterally from one side of said stacking portion, said storage portion having a discharge end opening toward the carton transporting conveyor, the discharge end of each receptacle being aligned with an end of a carton support when passing through said loading station, a stop member slidably mounted on each receptacle for movement between a raised position projecting into said path and a lowered position retracted from said path, stop actuator means operable to raise and lower said stop means as required in use to accumulate a stack of load items in said load stacking portion of its associated accumulating receptacle, load displacement means mounted on each receptacle for engaging and displacing load items with respect to said receptacle in a direction toward its discharge end, means for guiding the movement of the load displacement means as the receptacles are driven in said first direction to cause the load displacement means to reciprocate in at least one short stroke to laterally displace an accumulated stack of load items into the load storage portion and a long stroke to discharge an accumulated load from the load storage portion and the load stacking portion through the discharge end of the receptacle into an open end of a carton, drive means for continuously driving the load transporting conveyor, the load accumulating conveyor and carton transporting conveyor through said loading station, said drive means being adapted to drive the load transporting conveyor at a substantially greater speed than that of the load accumulating conveyor whereby a plurality of load supporting compartments will overtake each load accumulating receptacle as it is driven through said loading station with the stop associated therewith in the raised position thereby to cause load items to be accumulated in a stack in the underlying load stacking portion of the load accumulating receptacle.

PREFFERED EMBODIMENT

The invention will be more clearly understood after reference to the following detailed specification read in conjunction with the drawings wherein.

Packaging machines for use in end loading cartons and wrap-around forming of cartons are well known and will not therefor be discribed in detail herein. The present invention relates improvements in the load accumulating mechanism of a carton loading machine of any one of a number of known types.

Figure 1:
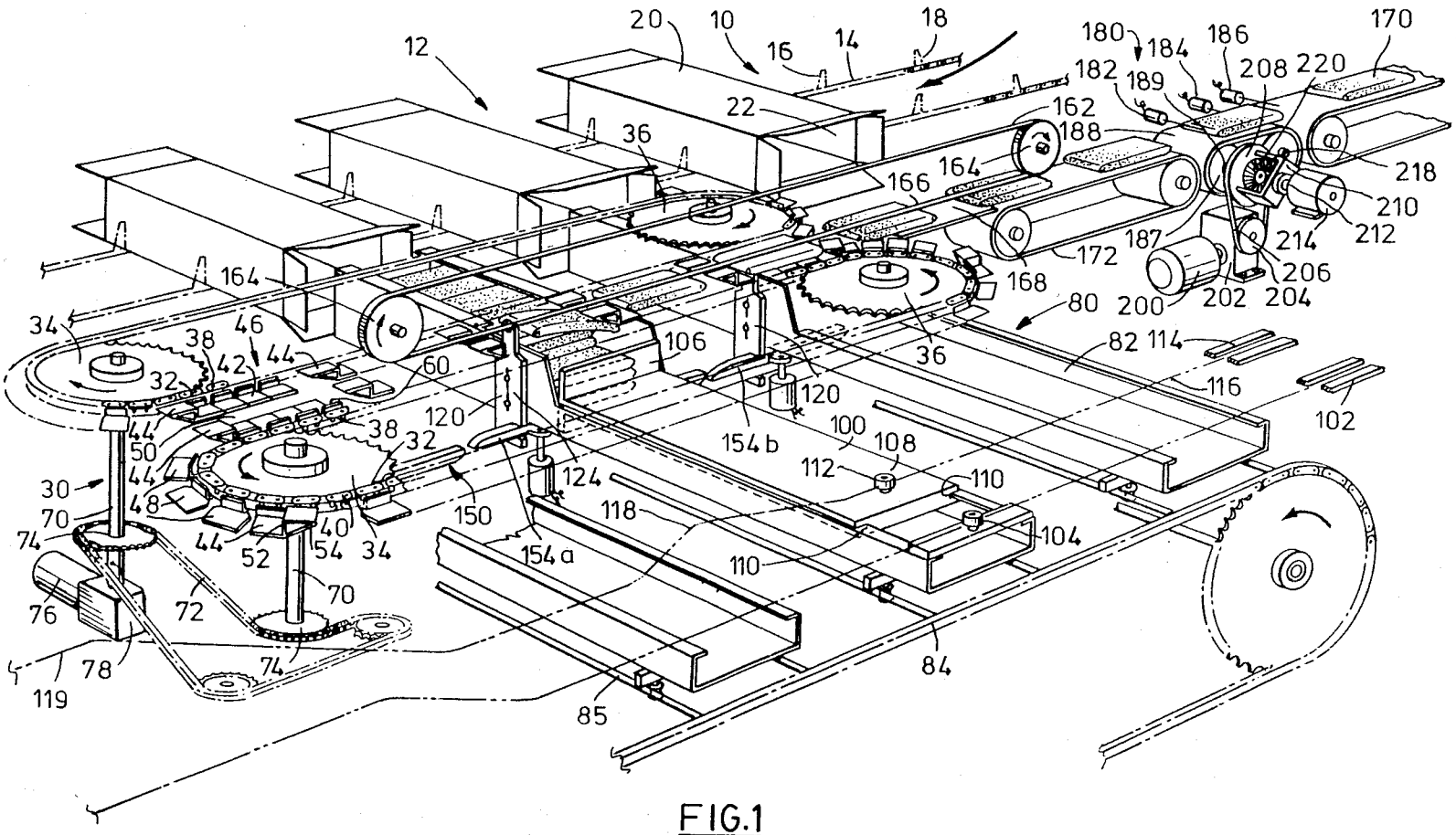
FIG. 1 is a pictorial view of the load accumulating and carton loading station of a carton loading machine.

With reference to FIG. 1 of the drawings, the reference numeral 10 refers generally to a packaging machine and the reference numeral 12 refers generally to the loading station of the packaging machine.

The packaging machine 10 has a container transporting conveyor 14 which has a plurality of stops 16 and 18 mounted thereon which serve to support a container such as the carton 20 in an open configuration with the open end 22 thereof opening laterally from one side of the conveyor 14. The conveyor 14 is operable to continuously drive the open cartons 20 through the carton loading station 12.

A load transporting conveyor is generally identified by the reference numeral 30. The load transporting conveyor 30 comprises a pair of endless chains 32 which are mounted on sprockets 34 and 36 such that the forward run portions 38 thereof extend through the carton loading station 12 in a spaced parallel relationship. The chains 32 each have a plurality of links 40 which support brackets 42 and 44. The brackets 42 and 44 are arranged over the forward run to form a plurality of load supporting compartments 46 which are separated from one another by longitudinally spaced brackets 44. The brackets 42 are L-shaped and include a flange 48 which projects laterally therefrom. The flanges 48 of the brackets 42 on opposite sides of the forward run are spaced from one another to provide a gap 50 which extends longitudinally of the forward run. The brackets 44 each have an upright end wall 52 which forms the leading end of a compartment 46 and an angularly inclined ramp 54 which forms the trailing end of the preceding compartment 46. The angularly inclined ramp 54 is spaced longitudinally from the trailing edge of the preceding bracket 42 to form a discharge passage 60 therebetween. The sprockets 34 are driven continuously and any convenient power source may be used for this purpose. For example, the shafts 70 on which the sprockets 34 are mounted may be interconnected by a chain 72 and sprockets 74, one of the shafts 70 being driven by a motor 76 through a gearbox 78.

The load receiving means generally identified by the reference numeral 80 is in the form of a plurality of load accumulator receptacles 82 which are mounted at spaced intervals along a load accumulator conveyor 84.

Figure 5:
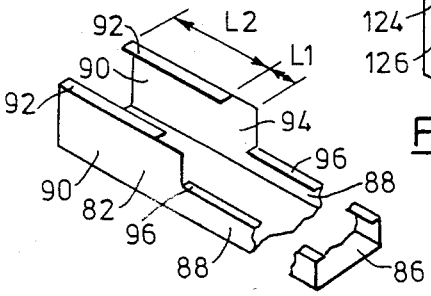
FIG. 5 is a pictorial view of one of the receptacles of FIG. 1.
Figure 6:
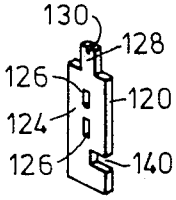
FIG. 6 is a pictorial view of one of the stop members of FIG. 1.

The structure of the receptacles 82 is illustrated in FIGS. 1 and 5 of the drawings.

With reference to FIG. 5 of the drawings, it will be seen that each receptacle 82 has a bottom wall panel 86 and short side walls 88 and long side walls 90 which project upwardly from the bottom panel to form a U-shaped trough. The side walls 90 extend over the length L1 of the load stacking portion and the length L2 of the load storing portion of the receptacle. Flanges 92 extend inwardly from the upper edges of the side walls 90 over the length L2 of the storage portion and serve to prevent upward removal of load items. The load stacking portion L1 has an upwardly opening input passage 94.

Flanges 96 are formed at the upper edge of the low wall portions 88 and serve to provide guide rails for the pusher assembly which is generally identified by the reference numeral 100 in FIG. 1.

The receptacles 82 are mounted to reciprocate on rails 85 which extend transversely across the load accumulator conveyor. A guide track 102 controls the movement of a follower 104 which is mounted on each receptacle 82. During passage of the receptacles 82 through the loading station, the track 102 serves to position the discharge end of each receptacle directly opposite and adjacent the open end of a carton.

Each of the pusher members 100 includes an end plate 106 and a slide plate 108. The end plate 106 is proportioned to fit in a free-fitting sliding relationship between the walls 90 of the receptacle. A slot 110 is formed at each side of the slide plate 108 and extends longitudinally thereof. The slot 110 is proportioned to receive the flanges 96 of the side walls 88 of the receptacle in a free-fitting relationship. A follower roller 112 is mounted on the plate 108 and extends upwardly therefrom into a guide track 114. The guide track 114 is arranged to cause the follower 112 to travel along a guide path 116 which includes a plurality of nodes 118 which are effective in causing the pusher 100 to reciprocate with respect to its associated receptacle.

Stop means in the form of a stop member 120 is slidably mounted on the side wall 90 of each receptacle which is located on the upstream side of each receptacle. The stop members 120 are aligned with the load stacking portion L1 of the receptacle.

Figure 4:
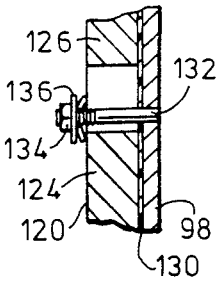
FIG. 4 is an enlarged detail of the area 4 of FIG. 3.

As shown in FIG. 5 of the drawings, each stop member 120 comprises a main body portion 124 within which two longitudinally elongated slots 126 are formed. A narrow head portion 128 projects upwardly from the body 124 and is formed with a notch 130. As shown in FIG. 4 of the drawings, a ware pad 130 is mounted on the face of the side wall 90 to be located between the side wall 90 and the stop member 120 to facilitate reciprocating movement of the stop member 120. The stop member 120 is retained by pins 132 which are anchored to the side wall 90 and have a threaded nut 134 at the outer end thereof which bears against spring washers 136 which are sufficiently resilient to permit the stop member 120 to reciprocate vertically with respect to the side wall 90 of the receptacle 82. The stop member 120 also has a notch 140 opening inwardly from one side edge thereof.

Figure 2:
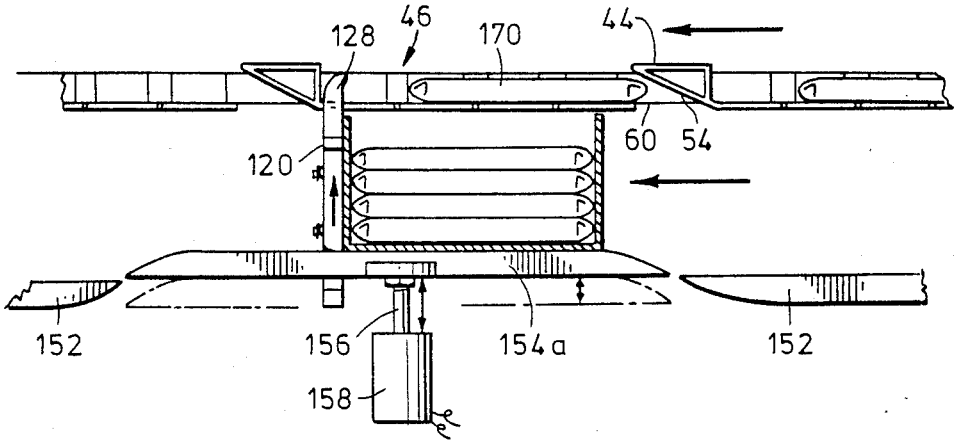
FIG. 2 is a cross-sectional view through a load transporting conveyor and load accumulator receptacle illustrating one step in the accumulation of load items.
Figure 3:
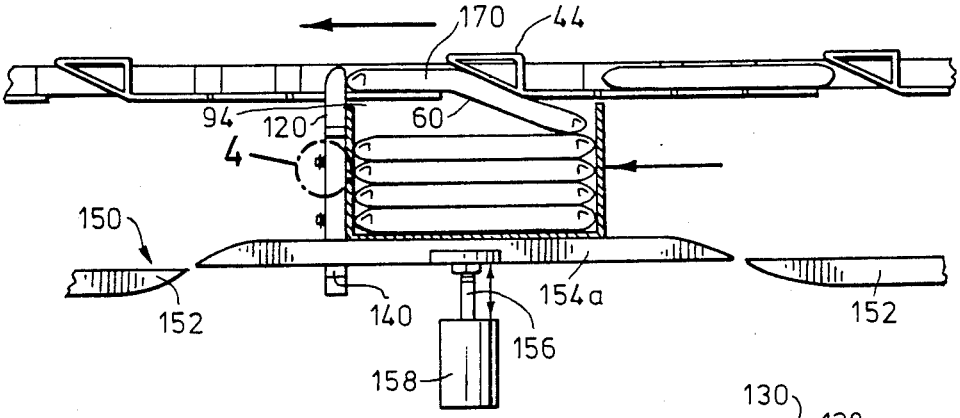
FIG. 3 is a sectional view similar to FIG. 2 showing a further step in load accumulation.

During passage of the receptacles 82 through the loading station, the notches 140 of the stop members 120 receive a guide rail generally identified by the reference numeral 150 which extends longitudinally of the loading station. The guide rail comprises a plurality of fixed lengths 152 and movable lengths 154*a* and 154*b*. The movable lengths 154*a* and 154*b* are mounted on the reciprocating ram 156 of solenoids 158. The solenoids 158 may be activated to raise the movable lengths 154*a* and 154*b* to the raised position shown in solid lines in FIG. 2 of the drawings and the lowered position shown in broken lines in FIG. 2 of the drawings. When in the lowered position, the movable section 154 is aligned with the stationary sections 152 and serves to locate the stop member 120 in its lowered position and when in the raised position the movable sections 154 serve to locate the stop members in the raised position. In the raised position, the head portion 128 of the stop member projects into the gap 50 and extends into the path of travel of the load units.

To prevent upward displacement of the load units as they are driven through the loading station, an overhead conveyor belt 160 is mounted on pulleys 164 and has a forward run 166 which extends longitudinally of the loading station above the load supporting compartments of the load transporting conveyor and effectively forms an upper wall of the load transporting compartments. When the stop members 120 are in the raised position, the conveyor belt 162 extends through the notch 130.

A platform 168 is located at the entrance to the forward run of the load transporting conveyor and extends below a portion of the forward run 166 of the overhead conveyor 162. A further conveyor 172 serves to transport the load items 70 to the platform 168.

In order to provide for accurate spacing of the load items to ensure that they are correctly spaced prior to entry into the load supporting compartments of the load transporting conveyor, I provide a spacer mechanism generally identified by the reference numeral 180. The spacer mechanism includes three sensors 182, 184 and 186 which detect the position of the load items 170 as they are loaded onto and transported across a conveyor belt 188. A motor 200 is drivingly connected to a gearbox 202 which has an output drive pulley 204. The drive pulley 204 is connected by means of a drive belt 206 to a pulley 208. The pulley 208 is journaled on the shaft 189 of the roller 187 which supports the conveyor 188. A U-shaped bracket 210 is mounted on the pulley 208. The U-shaped bracket 210 is journaled on the output shaft 212 of a second motor 214. A sun gear 202 is mounted on the shaft 189 and a second sun gear (not shown) is mounted on the output shaft of the second motor 214. Planerary gears 218 are mounted on the bracket 210 and mesh with both sun gears. This mechanism is operable by adjusting the speed of rotation of the second motor under the influence of the sensors 182, 184 and 185 to control the input to the load transporting conveyor. By this mechanism, it is possible to control the speed of the conveyor 188 to provided the required spacing between successive load items 170.

In use, load items 170 are fed to the platform 168 in the required spaced relationship and are then driven off of the platform 168 by the overhead conveyor 166 so as to enter the load supporting compartment which is being formed at the input end of the load transporting conveyor. The load items are then transported into the loading station and will continue therethrough until their forward movement is arrested by engagement with a raised stop member. While the forward movement of the load items 170 are arrested by the stop member 120, the load supporting conveyor will continue on its way through the loading station with the result that relative movement will occur between the load items 170 and the compartment 46 in which the load item is located. This will result in the ramp 54 which is located at the trailing end of the compartment 46 engaging the trailing end of the load item 170 to deflect the load item 170 through the discharge passage 60 into the load stacking portion 94 of the receptacle 82. Load items 170 will continue to be loaded into the load stacking portion 94 until the required stack of load items has been accumulated, thereupon one of the other stop members 120 will be activated to move to the raised position and the previously raised stop member will be lowered. During this loading of the load stacking portion of the load accumulating receptacle, the load accumulating receptacles are being driven longitudinally and once the required number of load items have been stacked in the stacking portion, the follower 122 of the pusher 100 begins to move along a node 118 of the guide track 116 thereby causing the pusher 100 to reciprocate to laterally displace the stack of load items from the load stacking portion of the receptacle into the load storage portion of the receptacle. While this lateral displacement is occurring, the load stacking portion of the receptacle which has its stop member raised is being filled. This sequence of loading the load items into the load stacking portion of the receptacle and then laterally displacing the load items into the load storage portion of the receptacle, will continue to be repeated until the receptacle is fully loaded with load items. At this point, the follower 112 of the pusher will have arrived at the node 119 of the track 116 whereupon the pusher will be activated to discharge the entire load into the container 20 through the open end 22 thereof. In view of the fact that two or more receptacles 82 may be arranged to sequentially receive load items from the load transporting conveyor, the load transporting conveyor may be driven at a very high speed in relation to the speed of forward travel of the receptacles. The fact that the articles are merely discharged through a discharge passage in each compartment, permits very high speed operation of the load transporting conveyor.

From the foregoing it will be apparent that the carton loading mechanism of the present invention provides for a very smooth flowing discharge of load items from the load transporting compartments of the load transporting conveyor. Furthermore, by providing a load arresting mechanism in association with each load accumulating receptacle, it is possible to selectively load the stacking portion of one receptacle while laterally displacing the previously accumulated load of another receptacle, this feature contributes to the ability of the packaging machine to operate at high speed.

Various modifications of the packaging machine of the present invention will be apparent to those skilled in the art. It will be understood that while only three loading receptacles are illustrated in the loading station of the machine of FIG. 1, this is merely for the purposes of simplifying the illustration of the invention. Many more load accumulating receptacles may be located in the loading station, the greater the number of load accumulating receptacles which are provided in the loading station, the greater the speed with which loading can be effected because of the increased availability of vacant load stacking compartments. These and other modifications of the present invention will be apparent to those skilled in the art.

I claim:

1. In a packaging machine having a loading station in which load items are loaded into a container, the improvement of;

(a) a load transport conveyor having a forward run extending through said loading station in a first direction along a first path, (b) a load supporting compartment formed on said conveyor, said compartment having a leading end and a trailing end, (c) a discharge passage opening from the trailing end of said compartment, (d) guide means at the trailing end of said compartment for guiding a load item toward said discharge passage, (e) receiver means located in said loading station for receiving a load item discharged from said load supporting compartment, (f) stop means located in said loading station and extending into said path upstream of said receiver means whereby the movement of a load item carried by said load supporting compartment along said path in said first direction is arrested by contact with said stop means and continued movement of the load transporting conveyor causes the load item to engage the guide means to be directed thereby through the discharge passage into the receiver means, and, (g) means for discharging the load item from the receiver means.

2. A packaging machine as claimed in claim 1, wherein a plurality of load supporting compartments are formed in the forward run of said conveyor at spaced intervals along the length thereof.

3. A packaging machine as claimed in claim 2, wherein said receiver means comprises a load accumulating receptacle which has a vertically elongated load stacking portion proportioned to accommodate a stack of load items.

4. A packaging machine as claimed in claim 3, wherein said load accumulator receptacle has a load storage portion extending laterally from the load stacking portion, said means for discharging the load being adapted to laterally displace at least one accumulated stack of load items from the load stacking portion into said load storage portion prior to discharge thereof.

5. A packaging machine as claimed in claim 4, wherein said storage portion is proportioned to accommodate a plurality of stacks of load items in a side-by-side relationship.

6. A packaging machine as claimed in claim 5, wherein said load accumulator receptacle has an open end through which an accumulated load may be laterally discharged.

7. A packaging machine as claimed in claim 2, wherein said receiver means comprises a plurality of load accumulator receptacles mounted on an accumulator conveyor for movement through said station, said stop means comprising a stop member mounted upstream of each load accumulator receptacle, said stop members being mounted for movement into and out of said path thereby to selectively permit the passage of a load item beyond its associated load accumulator receptacle and means for moving said stop means between said raised and lowered position as required in use.

8. A packaging machine as claimed in claim 7 further comprising drive means for continuously driving said load transporting conveyor and said load accumulator conveyor through said station, said drive means being adapted to drive said load transporting conveyor at a speed which is substantially greater than that of the load accumulator conveyor whereby the load supporting compartments overtake the load stacking portions of the load accumulator receptacles to discharge load items into the load stacking portions of the load accumulator receptacle associated with a step member disposed in a raised position.

9. A packaging machine as claimed in claim 8, wherein said discharge passage opens downwardly from each compartment and said load accumulator receptacles are located below said load transporting conveyor and extend transversely thereof during passage through said loading station.

10. A packaging machine as claimed in claim 9, wherein said load transporting conveyor includes an overhead conveyor belt extending through the loading station, said overhead conveying belt having a forward run overlying the load storage compartment in said loading station to prevent upward removal of load items therefrom.

11. A packaging machine as claimed in claim 9, wherein said guide means comprises a ramp which forms the trailing end of each compartment, said ramp being downwardly and rearwardly inclined toward its associated discharge passage.

12. In a packaging machine for loading end loading cartons having a carton transporting conveyor which has a plurality of carton supports adapted to transport open ended cartons through a carton loading station, the improvement of;

(a) a load transporting conveyor having a forward run extending through said loading station in a first direction along a first path, (b) a plurality of load supporting compartments formed on said load transporting conveyor at spaced intervals along the length of the forward run, each compartment having a leading end and a trailing end, (c) a discharge passage opening downwardly from each compartment at the trailing end thereof, (d) a guide ramp at the trailing end of each compartment extending downwardly and rearwardly toward the discharge passage, (e) a load accumulator conveyor mounted for movment through said loading station, (f) a plurality of load accumulating receptacles mounted on said load accumulator conveyor for movement through said loading station, each of said receptacles having a load stacking portion underlying said path of said load supporting compartments and a load storage portion extending laterally from one side of said stacking portion, said storage portion having a discharge end opening toward the carton transporting conveyor, the discharge end of each receptacle being aligned with an end of a carton support when passing through said loading station, (g) a stop member slidably mounted on each receptacle for movement between a raised position projecting into said path and a lowered position retracted from said path, (h) stop actuator means operable to raise and lower said stop means as required in use to accumulate a stack of load items in said load stacking portion of its associated accumulating receptacle, (i) load displacement means mounted on each receptacle for engaging and displacing load items with respect to said receptacle in a direction toward its discharge end, (j) means for guiding the movement of the load displacement means as the receptacles are driven in said first direction to cause the load displacement means to reciprocate in at least one short stroke to laterally displace an accumulated stack of load items into the load storage portion and a long stroke to discharge an accumulated load from the load storage portion and the load stacking portion through the discharge end of the receptacle into an open end of a carton, (k) drive means for continuously driving the load transporting conveyor, the load accumulating conveyor and carton transporting conveyor through said loading station, said drive means being adapted to drive the load transporting conveyor at a substantially greater speed than that of the load accumulating conveyor whereby a plurality of load supporting compartments will overtake each load accumulating receptacle as it is driven through said loading station with the stop associated therewith in the raised position thereby to cause load items to be accumulated in a stack in the underlying load stacking portion of the load accumulating receptacle.

* * * * *